US011175085B2

(12) United States Patent
You et al.

(10) Patent No.: US 11,175,085 B2
(45) Date of Patent: Nov. 16, 2021

(54) REFRIGERATOR WITH A SELECTIVE ICEMAKER/DISPENSER WATER DISTRUBUTION

(71) Applicant: LG ELECTRONICS INC., Seoul (KR)

(72) Inventors: Jimin You, Seoul (KR); Youngho Yi, Seoul (KR); Sangphil Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1 day.

(21) Appl. No.: 16/529,007

(22) Filed: Aug. 1, 2019

(65) Prior Publication Data

US 2020/0041191 A1 Feb. 6, 2020

(30) Foreign Application Priority Data

Aug. 1, 2018 (KR) ..... 10-2018-0089934

(51) Int. Cl.
*F25C 5/00* (2018.01)
*F25C 5/20* (2018.01)
*F25D 23/12* (2006.01)

(52) U.S. Cl.
CPC ..... *F25C 5/22* (2018.01); *F25D 23/126* (2013.01); *F25C 2400/14* (2013.01)

(58) Field of Classification Search
CPC ..... F25C 2400/10; F25C 2400/14; F25D 2323/122
See application file for complete search history.

(56) References Cited

U.S. PATENT DOCUMENTS 2,781,153 A * 2/1957 Roberts ..... F25D 23/126 222/183
4,817,827 A 4/1989 Kito et al.
(Continued)

FOREIGN PATENT DOCUMENTS

CN 1151505 6/1997
CN 102472548 5/2012
(Continued)

OTHER PUBLICATIONS

Indian Office Action dated Aug. 3, 2020 issued in Application 201914030956.
(Continued)

*Primary Examiner* — Filip Zec
(74) *Attorney, Agent, or Firm* — KED & Associates LLP

(57) ABSTRACT

Disclosed is a refrigerator. The present invention provides a refrigerator having a freezer compartment and a refrigerator compartment, the refrigerator including an icemaker provided to the freezer compartment or a freezer compartment door configured to open/close the freezer compartment, a dispenser provided to a refrigerator compartment door configured to open/close the refrigerator compartment, a water tank provided to the refrigerator compartment door, the water tank having an inlet for putting in water and an outlet for supplying water to the dispenser, a pump configured to send the water supplied from the water tank to the icemaker, and a slide cap movably provided to the water tank so as to be selectively coupled to a passage connected to the pump.

18 Claims, 6 Drawing Sheets

(56) References Cited

U.S. PATENT DOCUMENTS

| | | | | |
|---|---|---|---|---|
| 5,813,246 | A * | 9/1998 | Oh | B67D 1/0835 137/614.04 |
| 5,971,213 | A | 10/1999 | Lee | |
| 9,557,097 | B2 * | 1/2017 | McMahan | B67D 1/1238 |
| 9,677,802 | B2 * | 6/2017 | Lee | F25C 5/22 |
| 9,915,468 | B2 * | 3/2018 | You | F25D 25/025 |
| 2008/0156015 | A1 * | 7/2008 | Meyerholtz | F25D 23/126 62/318 |
| 2008/0168791 | A1 * | 7/2008 | Nebbia | F25D 23/126 62/389 |
| 2009/0151375 | A1 * | 6/2009 | Tarr | F25D 11/025 62/180 |
| 2010/0287971 | A1 | 11/2010 | Lee et al. | |
| 2011/0067433 | A1 | 3/2011 | An et al. | |
| 2012/0111049 | A1 | 5/2012 | Kim et al. | |
| 2012/0227433 | A1 * | 9/2012 | Li | F25C 5/22 62/340 |
| 2013/0133352 | A1 | 5/2013 | Park et al. | |
| 2014/0283542 | A1 * | 9/2014 | Jang | F25D 23/126 62/340 |
| 2016/0083241 | A1 | 3/2016 | Koo | |
| 2016/0334158 | A1 | 11/2016 | Joo et al. | |
| 2016/0363246 | A1 * | 12/2016 | Crompton | F25D 23/126 |

FOREIGN PATENT DOCUMENTS

| | | |
|---|---|---|
| CN | 104344657 | 2/2015 |
| CN | 104613719 | 5/2015 |
| DE | 10 2007 023 304 | 11/2008 |
| EP | 2 600 085 | 6/2013 |
| EP | 3 406 992 | 11/2018 |
| GB | 2 118 700 | 11/1983 |
| IN | 201814017883 | 11/2018 |
| JP | H07-260303 | 10/1995 |
| JP | 2002-115960 | 4/2002 |
| JP | 2006-162224 | 6/2006 |
| KR | 10-2005-0117830 | 12/2005 |
| KR | 10-2017-0096326 | 8/2017 |
| WO | WO 2011/019202 | 2/2011 |
| WO | WO 2011/159116 | 12/2011 |

OTHER PUBLICATIONS

United States Office Action dated Feb. 5, 2021 issued in co-pending related U.S. Appl. No. 16/526,294.
European Search Report dated Jan. 2, 2020 issued in EP Application No. 19189410.4.
European Search Report dated Jan. 20, 2020 issued in EP Application No. 19189406.2.
Australian Office Action dated Mar. 5, 2020 issued in Application No. 2019210609.
Australian Office Action dated Mar. 6, 2020 issued in Application No. 2019210604.
Chinese Notice of Allowance dated May 31, 2021 issued in Application No. 201910708246.7.
Chinese Office Action dated Jan. 8, 2021 issued in Application No. 201910708246.7 (English translation attached).
U.S. Appl. No. 16/529,007, filed Aug. 1, 2019.
U.S. Appl. No. 16/526,294, filed Jul. 30, 2019.

* cited by examiner (a)

(b)

REFRIGERATOR WITH A SELECTIVE ICEMAKER/DISPENSER WATER DISTRUBUTION

CROSS-REFERENCE TO RELATED APPLICATION

This application claims priority under 35 U.S.C. § 119 to Korean Application No. 10-2018-0089934 filed on Aug. 1, 2018, whose entire disclosure is hereby incorporated by reference.

BACKGROUND

1. Field

The present invention relates to a refrigerator, and more particularly, to a refrigerator having a dispenser and an icemaker.

2. Background

A refrigerator is equipped with a food storage space capable of blocking externally infiltrating heat with a cabinet and door filled with heat insulator. The refrigerator is equipped with a freezer consisting of an evaporator absorbing heat in the food storage space and a radiator discharging collected heat from the food storage space. Therefore, the refrigerator controls the food storage space to be maintained as a low-temperature area in which microorganisms have difficulties in survival and proliferation, thereby keeping the stored food away from spoiling for a long time.

A refrigerator has a refrigerator compartment for storing food in a temperature area above zero and a freezer compartment for storing food in a temperature area below zero. According to the disposition of a refrigerator compartment and a freezer compartment, refrigerators are classified into a top freezer refrigerator having a top freezer compartment and a bottom refrigerator compartment, a bottom freezer refrigerator having a top refrigerator compartment and a bottom freezer compartment, a side-by-side refrigerator having a left freezer compartment and a right refrigerator compartment, etc.

In order for a user to place or get the food stored in the food storage space conveniently, the refrigerator is equipped with a multitude of racks, drawers and the like provided in the food storage space. And, the refrigerator door is equipped with shelves, baskets and the like to store food, drinking water, etc.

Meanwhile, the refrigerator may be equipped with various convenience features. For example, the refrigerator can be equipped with a dispenser, an icemaker and the like. The dispenser is a device for a user to get water (e.g., drinking water) without opening the refrigerator door. And, the icemaker is a device for making and keeping ice by being located in the freezer compartment in general. In this case, water needs to be supplied to the dispenser and the icemaker.

SUMMARY OF THE INVENTION

Accordingly, embodiments of the present invention are directed to a refrigerator that substantially obviates one or more problems due to limitations and disadvantages of the related art.

An object of the present invention is to provide a refrigerator capable of supplying water to a dispenser and an icemaker efficiently using a single water tank.

Another object of the present invention is to provide a refrigerator, by which a water supply passage can be simplified while supplying water to a dispenser and an icemaker efficiently using a single water tank.

Further object of the present invention is to provide a refrigerator having a dispenser and an icemaker, by which user's convenience is improved.

Additional advantages, objects, and features of the invention will be set forth in the disclosure herein as well as the accompanying drawings. Such aspects may also be appreciated by those skilled in the art based on the disclosure herein.

The present invention can supply water to a dispenser and an icemaker from a single water tank.

The present invention is applicable to a refrigerator having a refrigerator compartment and a freezer compartment. The present invention is applicable to a refrigerator having a freezer compartment located at the top and a refrigerator compartment located at the bottom.

The dispenser may be provided to a refrigerator compartment door and the icemaker may be provided to the freezer compartment or a freezer compartment door. The water tank may be provided to the refrigerator compartment door, and a water supply passage may be connected to each of the dispenser and the icemaker from the water tank.

The water tank is disposed over the dispenser so that water in the water tank can be supplied to the dispenser by gravity. A pump for sending water of the water tank to the icemaker is usable. And, the pump may be disposed under the water tank.

The water tank may have an outlet for discharging water to the dispenser and a slide cap for supplying water to the icemaker.

The outlet may be projected from a lower part of the water tank toward a front side and configured in a manner of inclining at a prescribed angle. The slide cap may be provided to a top side of the water tank and coupled to the water supply passage to the pump selectively by moving in front and rear directions.

A passage to an entrance of the pump from the slide cap of the water tank may use an inside of the refrigerator compartment door, i.e., a space between an outer door and an inner door. A connector selectively removable from the slide cap may be provided to the inner door.

And, a passage to the icemaker from an exit of the pump may use the inside of the refrigerator compartment door, i.e., the space between in the outer door and the inner door.

Moreover, a passage between the refrigerator compartment and the freezer compartment may use a hinge shaft of a refrigerator door. For example, a hollow shaft is used as the hinge shaft, whereby the passage between the refrigerator compartment and the freezer compartment can be connected through a hollow portion of the hollow shaft.

Besides, an inlet for putting in external water may be provided to the water tank. And, a cap for selectively opening/closing the inlet may be provided thereto.

To achieve these objects and other advantages and in accordance with the purpose of the invention, as embodied and broadly described herein, a refrigerator having a freezer compartment and a refrigerator compartment according to one embodiment of the present invention may include an icemaker provided to the freezer compartment or a freezer compartment door configured to open/close the freezer compartment, a dispenser provided to a refrigerator compartment door configured to open/close the refrigerator compartment, a water tank provided to the refrigerator compartment door, the water tank having an inlet for putting in water and an outlet for supplying water to the dispenser, a pump configured to send the water supplied from the water tank to the icemaker, and a slide cap movably provided to the water tank so as to be selectively coupled to a passage connected to the pump.

According to an exemplary embodiment of the present invention, the refrigerator may further include a cap configured to selectively open/close the inlet.

According to an exemplary embodiment of the present invention, the slide cap may include an intake pipe communicating with the water tank and a discharge pipe having one end connected to the intake pipe and the other end selectively coupled to the passage.

According to an exemplary embodiment of the present invention, a perforated part enabling the intake pipe to communicate may be provided to the water tank and a catch portion may be provided to a prescribed position of the perforated part.

According to an exemplary embodiment of the present invention, the slide cap may further include a receiving part receiving the discharge pipe therein and a guide portion extending from the receiving part in right and left directions.

According to an exemplary embodiment of the present invention, a rail configured to guide the guide portion may be provided to the water tank.

According to an exemplary embodiment of the present invention, a first mark portion may be provided to the guide portion and a second mark portion corresponding to the first mark portion may be provided to the rail.

According to an exemplary embodiment of the present invention, the slide cap may further include a handle.

According to an exemplary embodiment of the present invention, the water tank may include a container configured to receive the water therein and a cover provided to a top side of the container.

According to an exemplary embodiment of the present invention, the cover may be removably coupled to the container.

According to an exemplary embodiment of the present invention, the slide cap and the rail may be provided to the cover.

According to an exemplary embodiment of the present invention, the pump may be received in a pump housing, a connecting member may be provided between the pump housing and the refrigerator compartment door, and a tube connected to an entrance of the pump may be provided within the connecting member.

According to an exemplary embodiment of the present invention, a holder may be provided to the refrigerator compartment door, a connector may be connected to the holder, and the tube may be connected to the connector.

According to an exemplary embodiment of the present invention, a supporter may be provided to the refrigerator compartment door and a tube guide may be connected to the supporter.

According to an exemplary embodiment of the present invention, a tube guide may be provided between the pump housing and a hinge shaft of the refrigerator compartment door, a tube communicating with an exit of the pump may be provided within the tube guide, and the tube guide may be provided between an outer door and an inner door of the refrigerator compartment door.

According to an exemplary embodiment of the present invention, the hinge shaft may include a hollow shaft and the tube guide or the tube may pass through a hollow portion of the hollow shaft.

According to an exemplary embodiment of the present invention, the tube guide may be provided between the hinge shaft and the icemaker, the tube connected to the icemaker may be provided within the tube guide, and the tube guide may be provided between an outer door and an inner door of the freezer compartment door.

According to an exemplary embodiment of the present invention, the pump housing may support the water tank.

In another aspect of the present invention, as embodied and broadly described herein, a refrigerator having a freezer compartment and a refrigerator compartment according to another embodiment of the present invention may include an icemaker provided to the freezer compartment or a freezer compartment door configured to open/close the freezer compartment, a dispenser provided to a refrigerator compartment door configured to open/close the refrigerator compartment, a pump provided to the refrigerator compartment door, a water tank provided to the refrigerator compartment door, the water tank having an outlet for supplying water to the dispenser and the pump, and a passage connecting an exit of the pump and the icemaker together, the passage connected to the freezer compartment through a hinge shaft of the refrigerator compartment door.

According to an exemplary embodiment of the present invention, the refrigerator may further include a slide cap movably provided to the water tank so as to be selectively coupled to the passage connected to the pump.

The respective features of the above-described embodiments can be configured in a manner of being combined with other embodiments unless contradictory or exclusive to other embodiments.

Accordingly, a refrigerator according to the present invention provides the following effects or advantages.

First of all, according to the present invention, water can be supplied to a dispenser and an icemaker efficiently using a single water tank.

Secondly, according to the present invention, a passage to a dispenser and an icemaker can be simplified despite using a single water tank.

Thirdly, according to the present invention, user's convenience can be improved by supplying water to a dispenser and an icemaker using a single water tank.

Effects obtainable from the present invention may be non-limited by the above mentioned effect. And, other unmentioned effects can be clearly understood from the following description by those having ordinary skill in the technical field to which the present invention pertains.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. The above and other aspects, features, and advantages of the present invention will become more apparent upon consideration of the following description of preferred embodiments, taken in conjunction with the accompanying drawing figures. In the drawings.

DETAILED DESCRIPTION

Reference will now be made in detail to a refrigerator according to the preferred embodiment of the present invention, examples of which are illustrated in the accompanying drawings. Although description will now be given in detail according to exemplary embodiments disclosed herein with reference to the accompanying drawings, the embodiments and drawings are used to help the understanding of the present invention.

Moreover, to help the understanding of the present invention, s the accompanying drawings may be illustrated in a manner of exaggerating sizes of some components instead of using a real scale.

Thus, the present invention is non-limited to the following embodiment, and it is intended that the present invention covers the modifications and variations of this invention provided they come within the scope of the appended claims and their equivalents.

Figure 1:
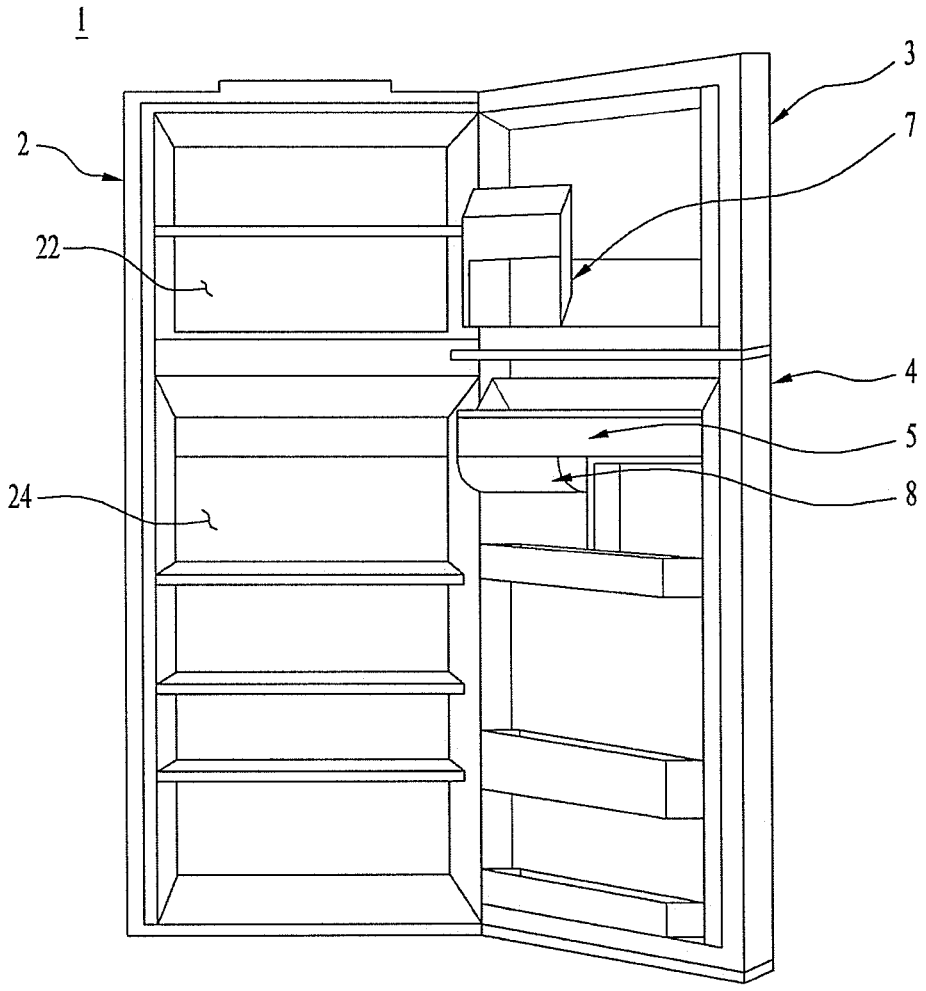
FIG. 1 is a front diagram showing a refrigerator according to an embodiment of the present invention.

First of all, an overall configuration of a refrigerator according to a preferred embodiment of the present invention is described with reference to FIG. 1. In the following description, a top-freezer refrigerator having a freezer compartment located provided to a top and a refrigerator compartment provided to a bottom is taken as an example.

For clarity of the following description, a refrigerator door direction shall be represented as a front and a freezer/refrigerator compartment direction shall be represented as a rear. Moreover, left and right directions are described with reference to viewing a refrigerator in a door direction.

A freezer compartment 22 is provided to a top side of a cabinet 2 configuring an exterior of a refrigerator 1, and a refrigerator compartment 24 is provided to a bottom side of the cabinet 2. A freezer compartment door 3 configured to open/close the freezer compartment 22 is rotatable coupled to the freezer compartment 22. And, a refrigerator compartment door 4 configured to open/close the refrigerator compartment 24 is rotatably coupled to the refrigerator compartment 24.

Meanwhile, an icemaker 7 is installed at the freezer compartment door 3 and a dispenser 9 (see FIG. 2) is installed at the refrigerator compartment door 4. Although the icemaker 7 can be installed within the freezer compartment 22 or at the freezer compartment door 3, the following description is made by taking an example of installing the icemaker 7 at the freezer compartment door 3.

A water tank 5 configured to receive water therein is removably provided to the refrigerator compartment door 4. A pump housing 8 is provided under the water tank 5, and a pump is installed within the pump housing 8.

The water of the water tank 5 can be provided to the dispenser and/or the icemaker 7 selectively or simultaneously. Namely, a passage for supplying the water of the water tank 5 to the dispenser is provided between the water tank 5 and the dispenser and a passage for supplying the water of the water tank 5 to the icemaker 7 is provided between the water tank 5 and the icemaker 7. [Specific passage structures shall be described later.]

In some implementations, the water tank 5 is preferably located over the dispenser. Therefore, the water supply from the water tank 5 to the dispenser can be achieved by gravity, i.e., free fall without using a separate pump. On the other hand, since the icemaker 7 is provided to the freezer compartment door 3, it is preferable that the water of the water tank 5 is sent to the icemaker 7 using a pump. An automatic icemaker is preferably used as the icemaker 7, by which the present invention is non-limited.

The water tank 5, the pump housing 8 and the dispenser 9 are described with reference to FIG. 2 as follows.

First of all, the water of the water tank 5 should be supplied to each of the dispenser 9 and a pump 6 within the pump housing 8.

Hence, an outlet 58 and a slide cap 10 are provided to the water tank 5. And, the water is supplied to the dispenser 9 and the pump 6 through the outlet 58 and the slide cap 10, respectively.

While the water tank 5 is separate from the refrigerator compartment door 4, the water of the water tank 5 is not discharged externally through the outlet 58 and the slide cap 10.

If a user couples the water tank 5 to the refrigerator compartment door 4, the outlet 58 of the water tank 5 is connected to the passage to the dispenser 9. Yet, the slide cap 10 of the water tank 5 is not connected to the passage to the pump 6. If a user pushes the slide cap 10 in a front direction, the slide cap 10 is connected to the passage to the pump 6. [Specific passage opening/closing structures of the outlet and slide cap shall be described later.]

The water tank 5 is described as follows.

First of all, water is received in the water tank 5. The water of the water tank 5 can be supplied to the dispenser 9 and the icemaker 7.

To this end, an inlet 548 for putting external water into the water tank 5 can be provided to the water tank 5. A cap 56 for selectively opening/closing the inlet 548 can be provided. And, an outlet 58 for supplying water to the dispenser 9 may be provided to the water tank 5. And, a slide cap 10 for supplying water to the icemaker 7 may be provided to the water tank 5.

In some implementations, although the water tank 5 may be formed integrally, it may be configured in a manner of including a container 52 and a cover 54. For clarity of the following description, the water tank 5 is described in a manner of being divided into the container 52 and the cover 52.

For example, the water tank 5 may include the container 52 having a prescribed space configured to receive water therein. The cover 54 may be removably coupled to a top side of the container 52. In order for a user to put water into the container 52, a cap 56 may be removably provided to the cover 54.

A shape of the container 52 is non-limited but may preferably have an approximately hexahedral shape of which inside is empty. And, it is preferable that a width (i.e., right-to-left length) of the container 52 may be substantially equal to or slightly smaller than a width of the refrigerator compartment door. A depth (i.e., front-to-rear length) and thickness (i.e., top-to-bottom length) of the container 52 can be selected appropriately.

Meanwhile, an outlet 58 is provided to the container 52. It is preferable that the outlet 58 is projected downward from a bottom of a front portion of the container 52. Water is supplied to the dispenser 9 through the outlet 58. A slide cap 10 is preferably provided to the cover 54 of the water tank 5. The slide cap 10 is preferably located in front of the cap 56. Water is supplied to the pump 6 through the slide cap 10.

Preferably, the outlet 58 is provided to the center of the container 52 approximately. Namely, as water is supplied to the dispenser 9 through the outlet 58, the dispenser 9 is generally located at the center of the refrigerator compartment door 4. Hence, if the outlet 58 is disposed at the center of the container 52, it is able to decrease a length of a passage.

The slide cap 10 may be disposed at the center of the cover 54. Meanwhile, the pump 6 plays a role in sending water of the water tank 5 to the icemaker 7 provided to the freezer compartment door 3. Yet, in order to decrease the length of the passage connected to the icemaker 7 from the pump 6, the pump 6 may be disposed to one side of the refrigerator compartment door 4, and more preferably, to a place adjacent to a portion at which a hinge shaft is installed. Hence, in order to decrease the passage, the slide cap 10 for supplying water to the pump 6 may be disposed in a manner of inclining in a direction of the hinge shaft.

Meanwhile, the outlet 58 is preferably provided in a manner of inclining downward in a front direction (e.g., an outdoor direction) of the refrigerator compartment door. This is because the dispenser 9 connected to the outlet 58 is provided in front of the refrigerator compartment door.

The coupling between the outlet 58 of the water tank 5 and the dispenser 9 is described as follows.

First of all, a valve 59 is coupled to the outlet 58 of the water tank 5, and the valve 59 is coupled to the dispenser 9. If a user pushes a lever 94, the valve 59 becomes open so that the water of the water tank 5 can be externally discharged through the outlet 58 and the valve 59. As the structure of the dispenser 9 is popularly known and used, its details shall be omitted.

The slide cap 10 is described as follows.

First of all, the slide cap 10 moves in front and rear directions, thereby being selectively coupled to the passage to the pump 6.

The structure of the slide cap 10 is described first. The slide cap 10 includes an intake pipe 17 inserted into the water tank 5 and a discharge pipe 16 connected to the intake pipe 17 and coupled to the passage to the pump 6 selectively. The intake pipe 17 extends into the water tank 5 in an approximately vertical direction through a perforated part 546 formed in the cover 54. One end of the discharge pipe 16 is connected to the intake pipe 17 and the other end extends in an approximately horizontal direction. The intake pipe 17 preferably extends to a bottom of the container 52.

A receiving part 18 configured to protect the discharge pipe 16 is preferably provided to the slide cap 10. A guide portion 12 is preferably provided to right and left sides of the receiving part 18. And, a handle 14 projected upward is preferably provided in rear of the receiving part 18 and the guide portion 12.

The receiving part 18 is configured to receive the discharge pipe 16 therein. Hence, the receiving part 18 is configured to have a receiving space in size approximately equal to a size of the discharge pipe 16.

For example, the receiving part 18 may include two side portions projected upward by contacting with right and left sides of the discharge pipe 16 and a connector connecting topsides of the two side portions together. The guide portion 12 preferably includes a panel type member extending outward from the two side portions of the receiving part 18.

Meanwhile, when the slide cap 10 moves in front and rear directions, the intake pipe 17 of the slide cap 10 should move in front and rear directions while inserted into the water tank 5.

Hence, the cover 54 is provided with the perforated part 546 corresponding to the trace of the intake pipe 17 moving in front and rear directions. A catch portion, on which the intake pipe 17 can be caught when the intake pipe 17 slides, may be provided to a prescribed position of the perforated part 546. For example, the catch portion may include recesses 546*a* and 546*b* provided to both sides of the perforated part 546, respectively. The recesses 546*a* and 546*b* include portions adjacent to the perforated part 546 recessed into the perforated part 546, respectively. In viewpoint of the perforated part 546, the recesses 546*a* and 546*b* may be regarded as the portions protruding into the perforated part 546.

When the intake pipe 17 of the slide cap 5 is located at the very rear/front, the recess 546*a*/546*b* plays a role in fixing the intake pipe 17 to the corresponding location. Moreover, when moving to the front/rear of the slide cap 5, the intake pipe 17 should pass through the recess 546*a*/546*b*. In doing so, there is slight resistance. Hence, a user can recognize the completion of the front/rear moving of the slide cap 10 owing to the recess 546*a*/546*b*.

Meanwhile, when the slide cap 10 moves in front and rear directions, it is preferable that the moving of the slide cap 10 is guided. To this end, the following structure is described.

As described above, the guide portion 12 is provided to the slide cap 10. A pair of rails 544 configured to guide the guide portion 12 are provided to the cover 54.

Each of the rails 544 includes a vertical portion 54*a* extending from the cover 54 vertically and a horizontal portion 544*b* extending inward from the vertical portion 54*a*. Namely, each of both side ends of the guide portion 12 is fitted between the vertical portion 544*a* and the horizontal portion 544*b* of each of the rails 544.

Hence, when the slide cap 10 moves in front-rear direction, the guide portion 12 of the slide cap 10 is guided by the rails 544. Moreover, since the discharge pipe 16 and the intake pipe 17 are fixed by the receiving portion, if the guide portion 12 on the right and left sides of the receiving portion moves in front-rear direction, the discharge pipe 16 and the intake pipe 17 move in the front-rear direction as well.

Meanwhile, as described above, while the water tank 5 is coupled to the refrigerator door 4, if a user moves the slide cap 10 to the front, the intake pipe 17 of the slide cap 10 is connected to the passage to the pump 6. Yet, it is preferable that a user can recognize whether the slide cap 10 is completely connected to the passage to the pump 6. To this end, the following structure is described.

A first mark portion 12*a* is provided to a prescribed position of the guide portion of the slide cap 10. And, a second mark portion 542*a* is provided to a prescribed position of the horizontal portion of the rail 544.

Preferably, the positions of the first and second mark portions 12*a* and 542*a* are aligned with each other when the slide cap 10 completely moves in the front direction. Each of the first and second mark portions 12*a* and 542*a* may use a print, a stamp or the like.

Meanwhile, as described above, the first recess 546*a* and the second recess 546*b* are formed at front and rear portions of the perforated part 546 of the cover 54, respectively. Namely, while the slide cap 10 is located at the very rear, the intake pipe 17 of the slide cap 10 is located in rear of the first recess 546*a*. If a user moves the slide cap 10 in the front direction, the user should push the intake pipe 17 in the front direction from the first recess 546*a*. Hence, the user feeds a little resistance from the first recess 546*a*.

Moreover, in order to completely move the slide cap 10 in the front direction, the user pushes the intake pipe 17 to pass the second recess 546*b*. Namely, the user feels a little resistance when the intake pipe 17 passes the first recess 546 or the second recess 546*b*. Hence, suing the first and second recesses 546*a* and 546*b*, the user can subsidiarily recognize an installed state of the slide cap 10.

The pump housing 8 is described as follows.

First of all, the pump housing 8 is coupled to an inside of the refrigerator compartment door 4. The pump 6 is provided within the pump housing 8. The pump housing 8 may include a front housing 8*a* and a rear housing 8*b* provided in rear of the front housing 8*a*.

The front housing 8*a* may preferably have an approximately hexahedral shape. Preferably, the rear housing 8*b* has a top-bottom height and a right-left width slightly greater than those of the front housing 8*b*. The rear housing 8*b* may play a role in supporting a portion of the water tank 5 installed over the rear housing 8*b* [See FIG. 3].

Meanwhile, it is preferable that a passage connecting an entrance of the pump 6 and the slide cap 10 is protected. To this end, a connecting member 80 may be provided between the pump housing 8 and the refrigerator compartment door 4.

A passage, e.g., a tube 62 may be received in the connecting member 80. The tube 62 can connect the entrance of the pump 6 and a connector 36 provided to the inner door of the refrigerator compartment door 4 [See FIG. 4]. [Specific structure of the connecting member shall be described later.]

A structure that the water tank 5 and the pump housing 8 are coupled to the refrigerator compartment door 4 is described with reference to FIG. 3 as follows.

First of all, the door is described. Generally, a door 22 includes an outer door 22 and an inner door (e.g., a door liner) 24 coupled to the outer door 22.

A top cap deco 28 is coupled to the top sides of the outer and inner doors 22 and 24, and a bottom cap deco (not shown) is coupled to the bottoms sides thereof.

A space formed by the outer door 22, the inner door 24, the top cap deco 26 and the bottom cap deco is filled up with an insulator 26.

Meanwhile, a seat portion 42 projected in an approximately horizontal direction is provided to the inner door 24. The water tank 5 is put on a top surface of the seat portion 42. The pump housing 8 is coupled to a bottom side of the seat portion 42. And, the pump 6 is provided within the pump housing 8. The rear housing 8*b* is projected from the seat portion 42 toward the refrigerator compartment, thereby playing a role in supporting the water tank 5 in part.

Meanwhile, a dispenser connector 92 is coupled to an approximate center of the seat portion 42 of the inner door 24. And, the valve 59 coupled to the outlet 58 of the water tank 5 is inserted in the dispenser connector 92.

Meanwhile, the water tank 5 is removably installed at the refrigerator compartment door 4. Normally, the water tank 5 is coupled to the refrigerator compartment door 4. In this state, if the water tank 5 is empty, a user opens the cap 56 of the water tank 56 and then puts water into the water tank 5.

In case that a user intends to clean the water tank 5, the water tank 5 is entirely separated from the refrigerator compartment door 4. In the state that the water tank 5 is separated from the refrigerator compartment door 4, the water of the water tank 5 should not be discharged externally. In the state that the water tank 5 is coupled to the refrigerator compartment door 4, water should be supplied to the dispenser 9 and the pump 6 through the outlet 58 of the water tank 5 and the slide cap 10.

Yet, the valve 59 is installed at the outlet 58 of the water tank 5. The valve 59 is normally in a closed state. If a user pushes a lever 94 of the dispenser 9, the valve 59 is open. Namely, as the valve 59 is coupled to the outlet 58, a separate passage open/close structure is not necessary. The valve 59 is generally used for the dispenser 9 and its details shall be omitted.

On the other hand, since the slide cap 10 is provided to the top side of the water tank 5, i.e., the cover 54, while the water tank 5 is separated, the water of the water tank 5 is not discharged through the discharge pipe 16 of the slide cap 10.

Yet, in case of attempting to connect the discharge pipe 16 of the slide cap 10 to the passage of the pump, a user manually moves the slide cap 10 in the front direction and then connects it to the passage of the pump. Namely, while the water tank 5 is coupled to the refrigerator compartment door 4 and the slide cap 10 is already moved in the front direction, the passage to the entrance of the pump 6 from the water tank 5 is connected. By the operation of the pump, the water on the entrance side of the pump is supplied to the icemaker 7.

Figure 3:
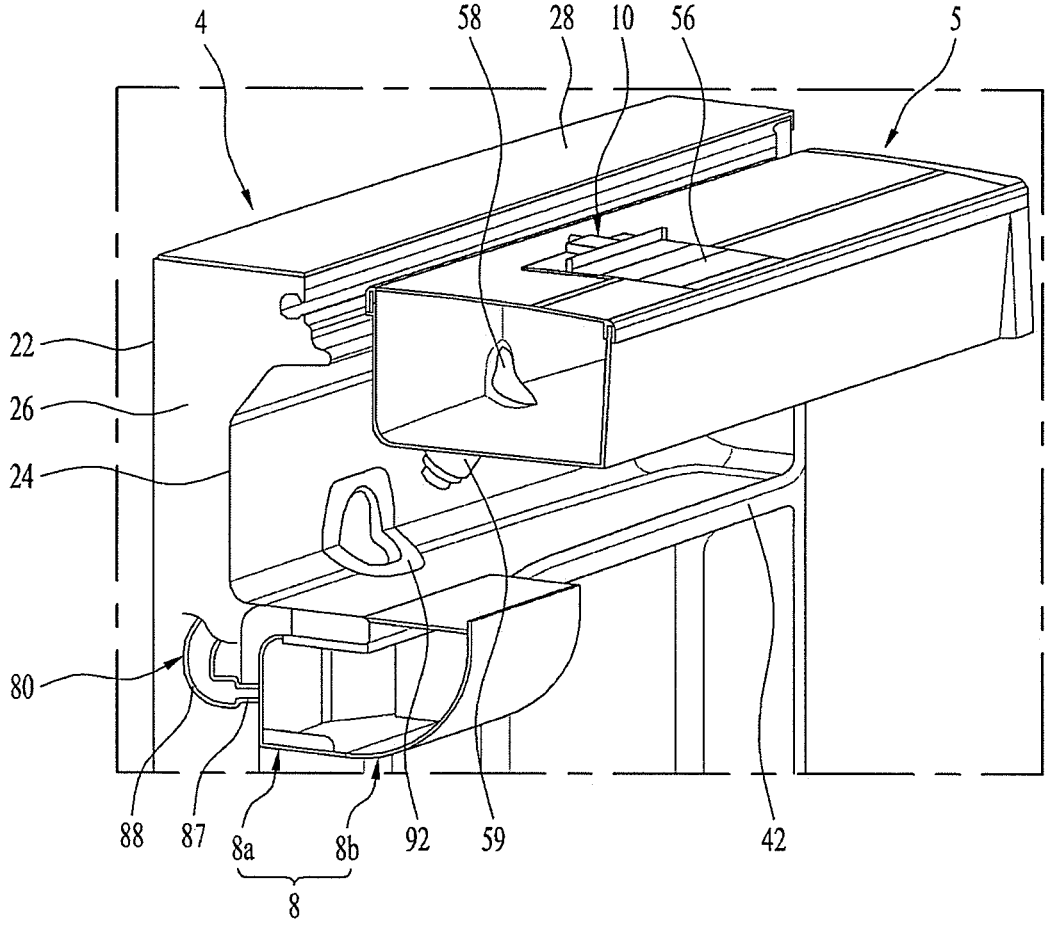
FIG. 3 is a cross-sectional diagram showing that a water tank and a pump housing door are installed at a door.
Figure 4:
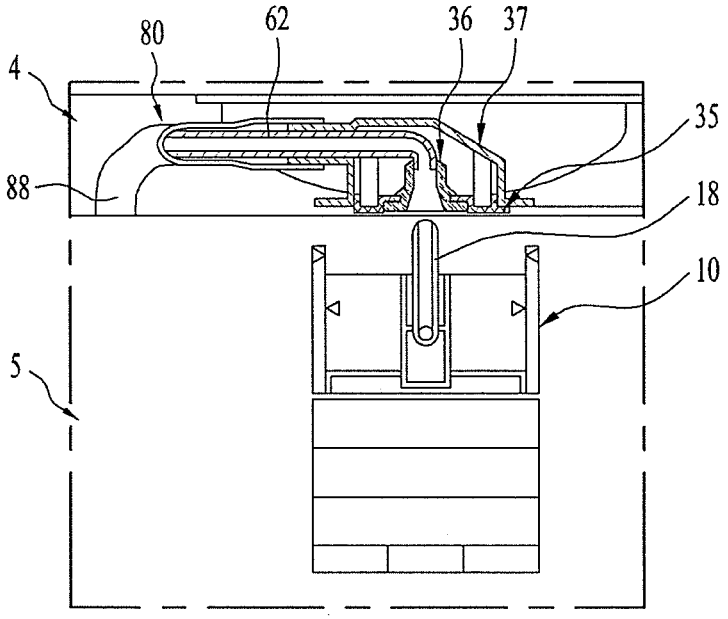
FIG. 4 is a cross-sectional diagram showing a removable structure of a slide cap of a water tank shown in FIG. 1.

With reference to FIG. 3 and FIG. 4, the passage between the slide cap 10 and the pump 6 is described as follows.

First of all, the connecting member 80 is provided between the pump housing 8 and the inner surface of the refrigerator compartment door 4. And, the tube 62 having one side connected to the entrance of the pump 6 is received in the connecting member 80.

The connecting member 80 is described as follows.

A tube joint 87 is coupled to an outside of the pump housing 8, and one side of a tube guide 88 is coupled to the tube joint 87. A supporter 37 is coupled to the other side of the tube guide 88, and a holder 35 is coupled to the supporter 37. Preferably, the connector 36 is coupled to the holder 35 so as to be supported thereby.

The supporter 37 is provided to the inner door 24 of the refrigerator compartment door 4, and one end of the tube guide 88 can be connected to the supporter 37. Moreover, the holder 35 is provided to the inner door 24 of the refrigerator compartment door 4, the connector 36 is coupled to the holder 35, and one end of the tube 62 can be connected to the connector 36. And, the supporter 37 and the connector 36 can be connected to the holder 35.

The holder 35 and the connector 36 are exposed to the inner surface of the refrigerator compartment door 4, and the connector 36 is coupled to the tube 62 received in the tube guide 88.

As the discharge pipe 16 of the slide cap 10 is selectively coupled to the connector 36, water is supplied to the pump 6.

The connector 36 is a part to which the discharge pipe 16 of the slide cap 10 is removably connected. A hole is formed in the inner door 24 of the refrigerator compartment door and the discharge pipe 16 of the slide cap 10 may be removably connected to the hole. Yet, it is preferable that water leakage is prevented. Hence, the connector 36 is preferably provided to the hole of the inner door 24. More preferably, the connector 36 is formed of such material as silicon and the like to prevent water leakage.

Figure 5:
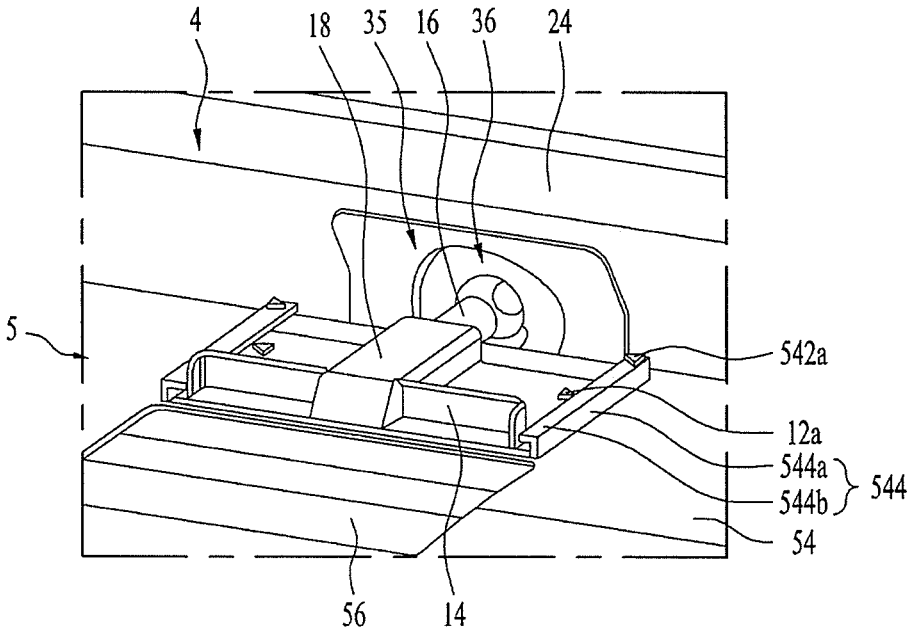
FIG. 5 is a perspective diagram showing a removable structure of a slide cap of a water tank shown in FIG. 1.
Figure 5:
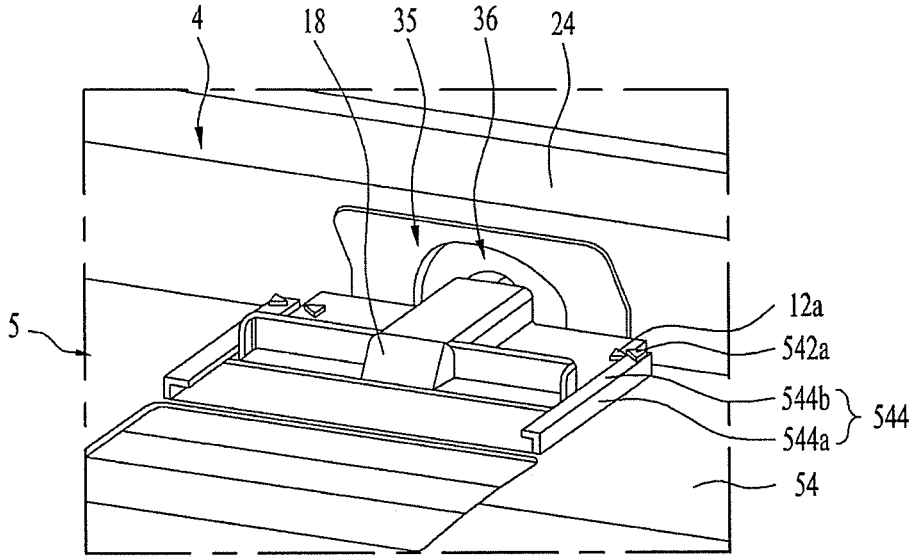

With reference to FIG. 4 and FIG. 5, the removable structure of the slide cap 10 of the water tank 5 is described as follows.

Referring to FIG. 5 (*a*), a user installs the water tank 5 at the refrigerator compartment door 4. In doing so, the slide cap 10 of the water tank 5 is located at the rear. Namely, the discharge pipe 16 of the slide cap 10 and the connector 36 of the refrigerator compartment door 4 are not coupled to each other, whereby the passage to the pump 6 is not connected yet.

After the water tank 5 has been installed at the refrigerator compartment door 4, the passage between the water tank 5 and the pump 6 should be connected. Hence, the user moves the slide cap 10 in the front direction.

If so, as shown in FIG. 5 (*b*), the discharge pipe 16 is inserted into the connector 36 of the refrigerator compartment door 4. Hence, the water of the water tank 5 can be supplied to the pump 6 via the discharge pipe 16 of the slide cap 10, the connector 36 and the tube 62.

Meanwhile, in order for a user to clean the water tank 5, the water tank 5 should be separated from the refrigerator compartment door 4. To this end, the user moves the slide cap 10 of the water tank 5 to the rear, thereby detaching the discharge pipe 16 of the slide cap 10 from the connector 36. In this state, if the water tank 5 is lifted from the refrigerator compartment door 4, the water tank 5 is separated from the refrigerator compartment door 4.

Figure 2:
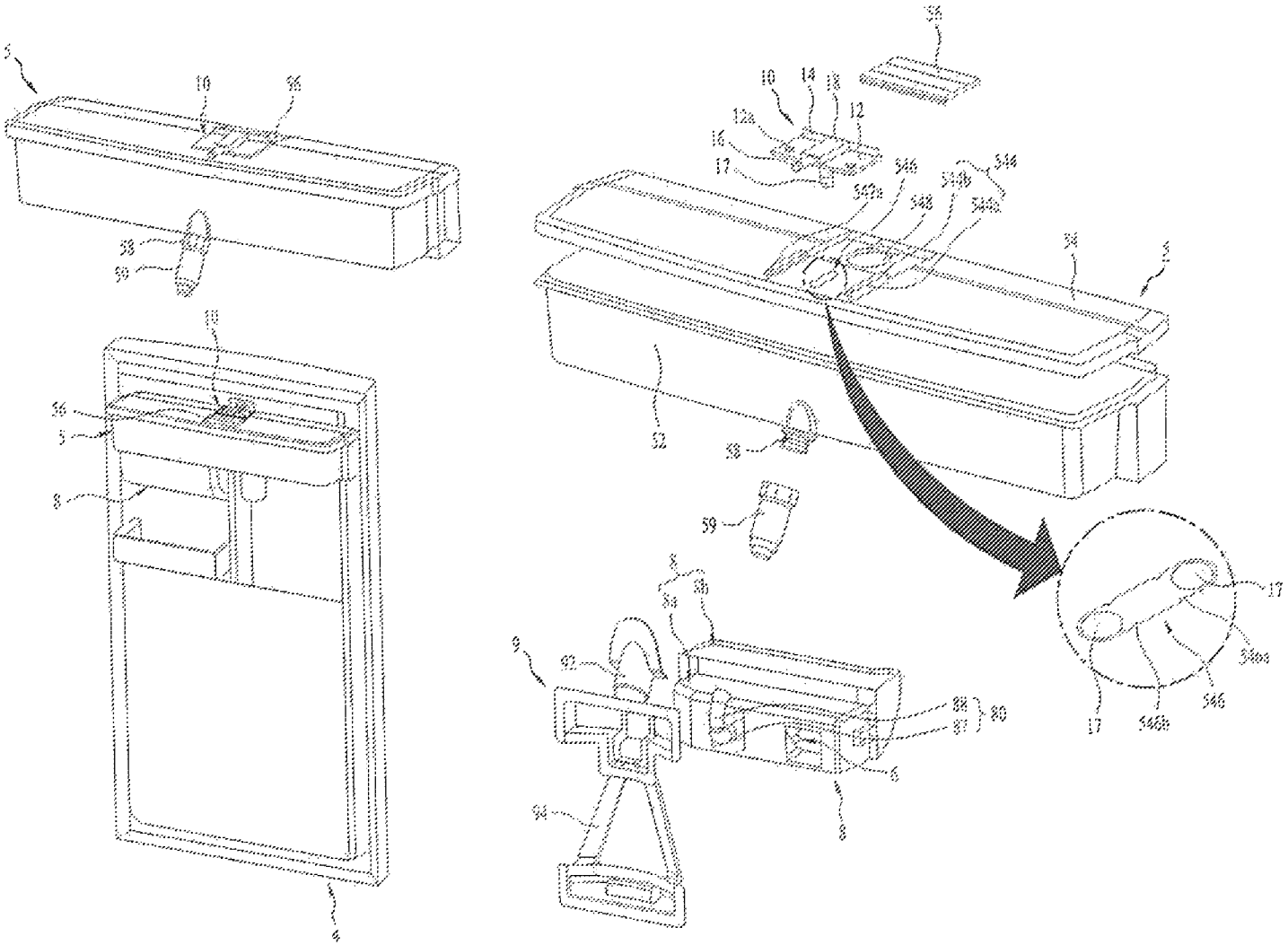
FIG. 2 is a perspective diagram showing a water tank, a dispenser and a pump housing shown in FIG. 1.
Figure 6:
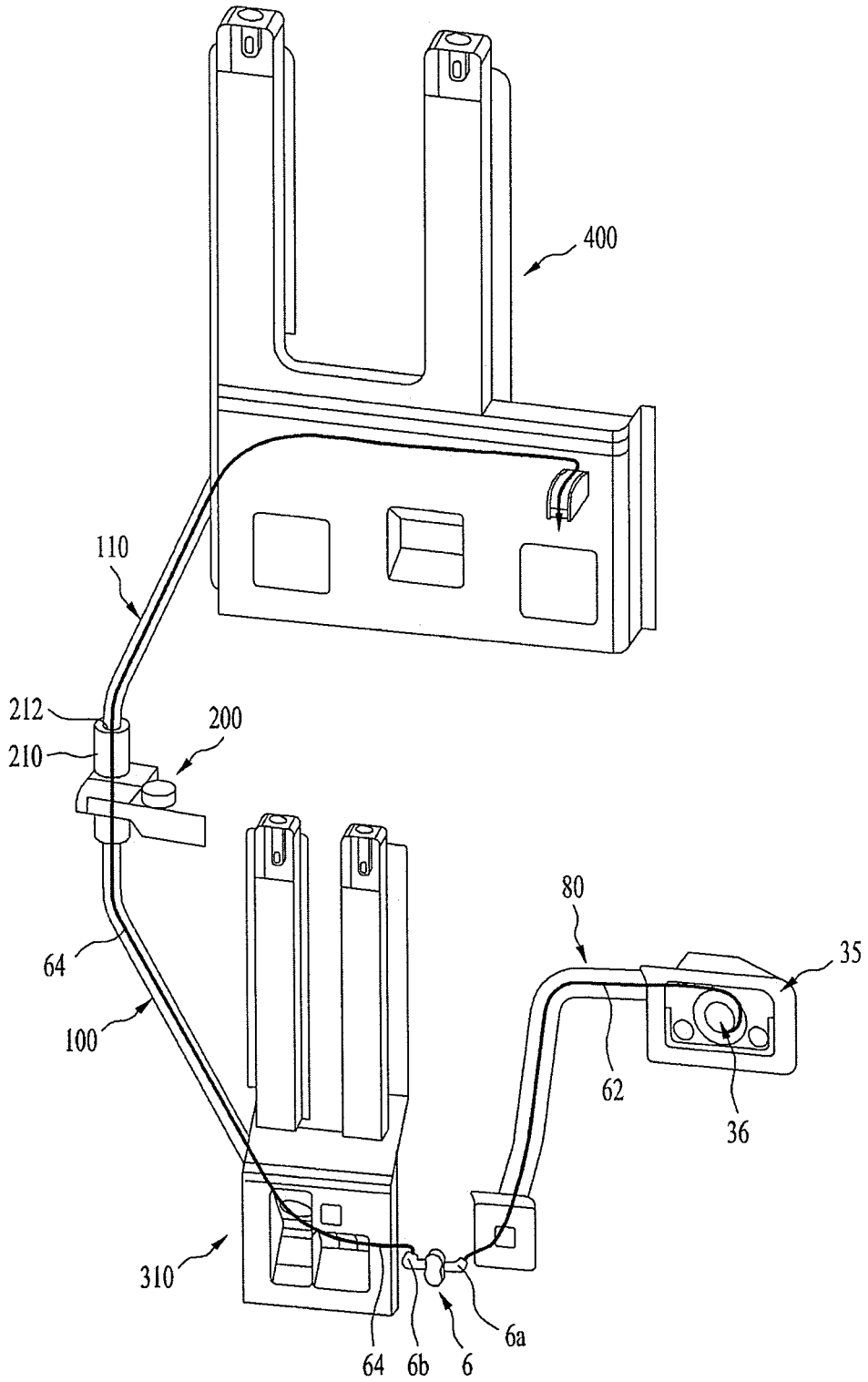
FIG. 6 is a perspective diagram showing a passage to a pump and icemaker from a water tank shown in FIG. 1.

With reference to FIG. 2 and FIG. 6, the passages from the water tank 5 to the dispenser 9 and the icemaker 7 are described as follows.

First of all, the passage from the water tank 5 to the dispenser 9 is described with reference to FIG. 2.

The water tank 5 is located above the dispenser 9. The valve 59 connected to the outlet 58 of the water tank 5 is coupled to a dispenser connector 92. Hence, the passage between the water tank 5 and the dispenser 9 is relatively short. Moreover, as the water tank 5 is located above the dispenser 9, a separate pump is unnecessary. If a user pushes the lever 94, the valve 59 is open and the water of the water tank 5 is externally discharged by gravity.

Next, the passage from the water tank 5 to the icemaker 7 is described with reference to FIG. 6.

The water tank 5 is provided to the refrigerator compartment door 4. Yet, since the icemaker 7 is provided to the freezer compartment door 3 located above the water tank 5, the pump 6 is required in order to send the water of the water tank 5 to the icemaker 7. Preferably, the supply of water to the icemaker 7 is performed selectively. Namely, water is preferably supplied to the icemaker 7 when an ice tray is empty. Hence, although the icemaker 7 is located below the water tank 5, the pump 6 is used preferably.

The passage from the water tank 5 to the icemaker 7 includes a passage from the water tank 5 to the entrance 6*a* of the pump 6 and a passage from the exit 6*b* of the pump 6 to the icemaker 7. A substantial passage from the water tank 5 to the entrance 6*a* of the pump 6 is the tube 62 starting from the discharge pipe 16 of the slide cap 10 of the water tank 5 up to the entrance 6*a* of the pump 6 via the connector 36.

Next, the passage connecting the exit 6*b* of the pump 6 to the icemaker 7 is described.

The pump 6 is installed at the refrigerator compartment door 4, and the icemaker 7 is installed at the freezer compartment door 3. Hence, the passage from the pump 6 to the icemaker 7 should connect the refrigerator compartment to the freezer compartment. The connection of the passage from the refrigerator compartment to the freezer compartment preferably uses a hinge shaft 210 of a hinge member 200. Namely, the passage from the refrigerator compartment to the freezer compartment is connected in a manner of using a hollow shaft as the hinge shaft 210 and also using a hollow portion 212 of the hinge shaft 210.

This is described in detail as follows.

First of all, the passage from the exit 6*b* of the pump 6 to the icemaker 7 preferably uses the tube 64 having flexibility. To protect the tube, the tube 64 is preferably received in a tube guide 100. The tube guide 100 includes a hollow pipe capable of receiving the tube therein and preferably uses a material having relative durability.

The tube guide 100 is connected between the pump housing 8 and the hinge shat 210. And. Another tube guide 110 is preferably connected between the hinge shaft 210 and the icemaker 7. The tube guide 100 may directly pass through the hollow portion 212 of the hinge shaft 210. Or, since the hinge shaft 210 is generally formed of metallic material, the tube 64 can directly pass through the hollow portion 212 of the hinge shaft 210 without using the tube guide 100 for the hollow portion 212 of the hinge shaft 210.

Meanwhile, the tube guide 100 from the pump housing 8 to the hinge shaft 210 is preferably buried in the insulator of the refrigerator compartment door. Moreover, the tube guide 110 from the hinge shaft 210 to the icemaker 7 is preferably buried in the insulator of the freezer compartment door.

Meanwhile, a supporter 310 configured to support the tube guide 100 entirely or in part may be provided.

With reference to FIGS. 2 to 4, an operation of the water tank 5 of the refrigerator according to the present embodiment is described as follows.

First of all, the water tank 5 is removable from the refrigerator compartment door 4. For example, when the water tank 5 is cleaned, a user separates the water tank 5 from the refrigerator compartment door 4. While the water tank 5 is separated, water is not discharged through the outlet 58 of the water tank 5 and the discharge pipe of the slide cap 10. This is because the outlet 58 is in a state that the passage is blocked by the valve 59 coupled to the outlet 58. And, the discharge pipe 16 of the slide cap 10 is located above the water tank 5.

Once the user finishes the cleaning of the water tank 5, the user installs the water tank 5 at the refrigerator compartment door 4 again. In doing so, the user can easily seat the water tank 5 on the refrigerator compartment door 4 without interference with other components such as a rack, a basket and the like. This is because the outlet 58 of the water tank 5 is projected downward at a prescribed angle in a front direction.

Once the water tank 5 is seated on the refrigerator compartment door 4, the water of the water tank 5 can be supplied to the dispenser 9 and/or the icemaker 7. As the passage of the vale 59 coupled to the outlet 58 is blocked even in the state that the water tank 5 is seated on the refrigerator compartment door 4, water is not discharged through the outlet 58. Yet, if a user pushes the lever 94 of the dispenser 9, an open signal is sent to the valve 59 so as to open the valve 59. As the valve 59 is open, water is discharged to the dispenser 9.

Meanwhile, while the water tank 5 is seated on the refrigerator compartment door 4, the passage of the pump is not connected to the discharge pipe 16 of the slide cap 10. Hence, by moving the slide cap 10 in the front direction, the discharge pipe 16 of the slide cap 10 is coupled to the connector 36 provided to the refrigerator compartment door 4. In this state, if a drive signal of the pump is sent to the pump 6 from the icemaker 7, the pump 6 operates to supply water to the icemaker 7.

Meanwhile, if the water of the water tank 5 is used all in the state that while the water tank 5 is seated on the refrigerator compartment door 4, a user can open the cap 56 of the water tank 5 and put water into the water tank 5 through the cap 56.

The matter of the above-described embodiment is identically applicable to other undescribed parts. Moreover, the technical matter described in one embodiment is identically applicable to another embodiment if it is not contrary mutually, unless otherwise specifically stated.

The top-freezer refrigerator is exemplarily described in the above embodiment, by which the present invention is non-limited. For example, the principle of the present invention is applicable to a bottom-freezer refrigerator. In this case, a water tank and a dispenser are preferably installed at a refrigerator compartment door and an icemaker is preferably installed in a freezer compartment. Although the water tank is located above the icemaker installed in the freezer compartment, it is preferable that water is selectively supplied to the icemaker. Hence, a pump is used preferably. Particularly, an auto-icemaker preferably uses a pump.

Moreover, the principle of the present invention is applicable to a side-by-side refrigerator. In this case, a water tank and a dispenser are preferably installed at a refrigerator compartment door and an icemaker is preferably installed in a freezer compartment. The icemaker installed in the freezer compartment may be installed higher or lower than the water tank. Since it is preferable that water is selectively supplied to the icemaker irrespective of the water tank installation height, a pump is used preferably as well.

It will be appreciated by those skilled in the art that various modifications and variations can be made in the present invention without departing from the spirit or scope of the inventions. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator having a freezer compartment and a refrigerator compartment, the refrigerator comprising:

an icemaker provided in a vicinity of the freezer compartment or at a freezer compartment door that is configured to open or close the freezer compartment;

a dispenser provided in a vicinity of a refrigerator compartment door that is configured to open or close the refrigerator compartment;

a water tank provided at the refrigerator compartment door;

a pump configured to receive water from the water tank and to provide the water to the icemaker; and a passage provided at the refrigerator compartment door;

wherein the water tank includes:

an inlet configured to receive water, an outlet configured to supply water from the water tank to the dispenser, and a slide cap movably provided at a top of the water tank to be selectively coupled to the passage, and the passage is coupled to the pump.

2. The refrigerator of claim 1, wherein the passage includes a first end to selectively couple to the slide cap, and a second end to couple to the pump.

3. The refrigerator of claim 2, the slide cap comprising:

an intake pipe that extends into the water tank; and a discharge pipe having a first end to couple to the intake pipe and a second end to selectively couple to the first end of the passage.

4. The refrigerator of claim 3, wherein the water tank includes a perforation at the top of the water tank to enable the intake pipe to communicate with the water tank, and wherein at least one recess is provided at a prescribed position of the perforation.

5. The refrigerator of claim 3, the slide cap comprising:

a receiving part to receive the discharge pipe; and a guide extending in a first side direction from the receiving part and extending in a second side direction from the receiving part.

6. The refrigerator of claim 5, wherein at least one rail is provided at the top of the water tank, the at least one rail is configured to guide movement of the guide.

7. The refrigerator of claim 6, wherein the slide cap includes a first mark on the guide, and wherein a second mark is provided at the at least one rail, wherein the first mark is aligned with the second mark when the slide cap is provided at a front position in which the second end of the discharge pipe is coupled to the first end of the passage.

8. The refrigerator of claim 7, wherein the slide cap comprises a handle.

9. The refrigerator of claim 1, wherein the water tank comprises:

a container configured to receive the water therein, and a cover provided at a top of the container.

10. The refrigerator of claim 9, wherein the cover is removably coupled to the container.

11. The refrigerator of claim 10, wherein the slide cap and at least one rail are provided at the cover.

12. The refrigerator of claim 1, comprising:

a pump housing to receive the pump, and a connecting member provided between the refrigerator compartment door and the pump housing, and wherein a tube is provided within the connecting member, and a first end of the tube is coupled to an input of the pump at the pump housing.

13. The refrigerator of claim 12, wherein a holder is provided at the refrigerator compartment door, a connector is coupled to the holder, and a second end of the tube is coupled to the connector.

14. The refrigerator of claim 13, wherein a supporter is provided at the refrigerator compartment door and a tube guide is coupled to the supporter.

15. The refrigerator of claim 13, wherein a tube guide is coupled between the pump housing and a hinge shaft of the refrigerator compartment door, wherein a tube is provided within the tube guide to communicate with an output of the pump in the pump housing, and wherein the tube guide is provided between an outer door and an inner door of the refrigerator compartment door.

16. The refrigerator of claim 15, wherein the hinge shaft includes a hollow shaft having a hollow portion, and wherein at least one of the tube guide or the tube passes through the hollow portion.

17. The refrigerator of claim 16, wherein the tube guide is coupled between the hinge shaft and the icemaker, wherein the tube is coupled to the icemaker and is provided within the tube guide, and wherein the tube guide is provided between an outer door and an inner door of the freezer compartment door.

18. The refrigerator of claim 12, wherein the pump housing is provided under the water tank and is configured to support the water tank.

* * * * *